US011084681B2

(12) United States Patent
Andersson et al.

(10) Patent No.: US 11,084,681 B2
(45) Date of Patent: Aug. 10, 2021

(54) STACK OF FOLDED HYGIENE PRODUCTS AND METHOD AND APPARATUS FOR PRODUCING SAME

(75) Inventors: Anders Andersson, Stenungsund (SE); Björn Larsson, Billdal (SE); Kenth Johansson, Uddevalla (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 922 days.

(21) Appl. No.: 14/236,147

(22) PCT Filed: Aug. 31, 2011

(86) PCT No.: PCT/EP2011/065027

§ 371 (c)(1),
(2), (4) Date: Jan. 30, 2014

(87) PCT Pub. No.: WO2013/029678

PCT Pub. Date: Mar. 7, 2013

(65) Prior Publication Data

US 2014/0135192 A1 May 15, 2014

(51) Int. Cl.
*B65H 45/06* (2006.01)
*B65H 45/20* (2006.01)
*B65H 45/24* (2006.01)

(52) U.S. Cl.
CPC ..... *B65H 45/06* (2013.01); *B65H 45/20* (2013.01); *B65H 45/24* (2013.01)

(58) Field of Classification Search
CPC ..... B65H 37/02; B65H 45/24; B65H 45/30; B65H 59/38; B65H 2301/43827; B26D 7/14

(Continued)

(56) References Cited

U.S. PATENT DOCUMENTS 3,044,766 A * 7/1962 Banks ..... B65H 45/20 493/433
3,722,776 A * 3/1973 Noe ..... B21D 1/05 226/195

(Continued)

FOREIGN PATENT DOCUMENTS

CN 1396858 A 2/2003
CN 101080188 A 11/2007

(Continued)

OTHER PUBLICATIONS

Office Action dated Jul. 28, 2015, by the Colombian Patent Office in corresponding Colombian Patent Application No. 14-064-573-3. (8 pages).

(Continued)

*Primary Examiner* — Thanh K Truong
*Assistant Examiner* — Patrick B Fry
(74) *Attorney, Agent, or Firm* — Buchanan Ingersoll & Rooney P.C.

(57) ABSTRACT

A method for producing stacks of individual web sections involves: (a) directing the continuous web to a perforating station; (b) perforating the continuous web at predetermined intervals and forming sheets of web material between consecutive perforation lines extending laterally across the continuous web, the perforating being carried out via at least one perforation element arranged at the circumference of a perforation roller; (c) directing the continuous web to a cutting station; (d) cutting at second predetermined intervals the continuous web into web sections via a cutting element acting against an anvil element, to generate a clear cut or a tab-bond; (e) folding the web sections via a folding roll; and (f) stacking the folded web section to generate a stack of folded sheets.

27 Claims, 4 Drawing Sheets

(58) Field of Classification Search
USPC ..... 493/233, 365; 428/43, 130; 226/195
See application file for complete search history.

(56) References Cited

U.S. PATENT DOCUMENTS

| | | | | | |
|---|---|---|---|---|---|
| 3,764,050 | A * | 10/1973 | Clark | B21B 37/48 | 226/25 |
| 3,867,826 | A * | 2/1975 | Noe | B21D 1/05 | 72/205 |
| 3,955,737 | A * | 5/1976 | Traise | B41F 13/02 | 226/108 |
| 4,494,741 | A * | 1/1985 | Fischer | B65H 45/24 | 270/39.09 |
| 4,691,606 | A * | 9/1987 | Johnson | B26D 7/14 | 83/175 |
| 4,691,908 | A * | 9/1987 | Bradley | B65H 45/24 | 270/21.1 |
| 4,725,469 | A | 2/1988 | Summerfield | | |
| 4,824,426 | A | 4/1989 | DuFresne | | |
| 4,854,984 | A * | 8/1989 | Ball | A44B 18/0011 | 156/73.5 |
| 4,874,158 | A * | 10/1989 | Retzloff | B65H 31/32 | 270/39.02 |
| 5,114,771 | A | 5/1992 | Ogg et al. | | |
| 5,151,077 | A * | 9/1992 | Cole, Jr. | B26F 1/24 | 493/353 |
| 5,205,808 | A | 4/1993 | Gebhardt | | |
| 5,232,431 | A * | 8/1993 | Helseth | A47F 3/00 | 24/30.5 T |
| 5,290,226 | A | 3/1994 | Green, Jr. | | |
| 5,332,118 | A * | 7/1994 | Muckenfuhs | A47K 10/421 | 206/494 |
| 5,899,447 | A * | 5/1999 | Muckenfuhs | B65H 45/24 | 270/32 |
| 6,165,116 | A * | 12/2000 | White | B65H 45/24 | 270/39.06 |
| 6,213,346 | B1 * | 4/2001 | Skerrett | A47K 10/42 | 221/48 |
| 6,213,927 | B1 * | 4/2001 | De Matteis | B65H 45/24 | 493/356 |
| 6,286,712 | B1 * | 9/2001 | Craig | B65H 45/30 | 206/494 |
| 6,548,136 | B1 | 4/2003 | Piccini et al. | | |
| 6,669,617 | B1 | 12/2003 | Sumida et al. | | |
| 6,820,869 | B2 * | 11/2004 | Lange | B26F 3/002 | 225/100 |
| 6,978,816 | B1 * | 12/2005 | Byrne | B65H 19/1836 | 156/157 |
| 7,326,161 | B2 * | 2/2008 | Ishikawa | B65H 26/02 | 270/20.1 |
| 8,877,313 | B2 * | 11/2014 | Larsson | B65H 45/24 | 428/100 |
| 9,004,313 | B2 * | 4/2015 | Andersson | B65H 45/24 | 206/449 |
| 2001/0020626 | A1 | 9/2001 | Skerrett et al. | | |
| 2003/0000357 | A1 | 1/2003 | Tanaka | | |
| 2003/0091786 | A1 | 5/2003 | Mansson | | |
| 2004/0121121 | A1 * | 6/2004 | Anderson | B26D 7/14 | 428/131 |
| 2008/0001339 | A1 * | 1/2008 | Tahara | B65H 45/16 | 270/41 |
| 2008/0028902 | A1 * | 2/2008 | Baggot | B26D 1/626 | 83/13 |

FOREIGN PATENT DOCUMENTS

| | | | |
|---|---|---|---|
| CN | 101670954 | A | 3/2010 |
| CN | 102020142 | A | 4/2011 |
| EP | 0287766 | A1 | 10/1988 |
| EP | 0 291 211 | A2 | 11/1988 |
| EP | 0323296 | A1 | 7/1989 |
| EP | 1023863 | A1 | 8/2000 |
| EP | 1 118 568 | A2 | 7/2001 |
| EP | 2 204 345 | A1 | 7/2010 |
| EP | 1443839 | B1 | 12/2014 |
| JP | H6-48652 | A | 2/1994 |
| WO | WO 00/00072 | A1 | 1/2000 |
| WO | WO 2006/071148 | A1 | 7/2006 |
| WO | 2013/007301 | A1 | 1/2013 |

OTHER PUBLICATIONS

Office Action (Notification of the First Office Action) dated May 29, 2015, by the Chinese Patent Office in corresponding Chinese Patent Application No. 201180073667.9, and an English Translation of the Office Action. (15 pages).

English Translation of the Office Action (Decision on Grant) dated Jul. 16, 2015, by the Russian Patent Office in corresponding Russian Patent Application No. 2014112219. (7 pages).

International Search Report (PCT/ISA/210) dated May 15, 2012, by the European Patent Office as the International Searching Authority for International Application No. PCT/EP2011/065027.

International Preliminary Report on Patentability (PCT/IPEA/409) dated Jul. 8, 2013, by the European Patent Office as the International Preliminary Examining Authority for International Application No. PCT/EP2011/065027.

Office Action (Notification of the First Office Action) dated Feb. 14, 2018, by the State Intellectual Property Office (SIPO) of the Peoples Republic of China in corresponding Chinese Patent Application No. 201710206198.2, and an English Translation of the Office Action. (20 pages).

Office Action (Communication pursuant to Article 94(3) EPC) dated Feb. 7, 2019, by the European Patent Office in corresponding European Application No. 16 152 711.4-1017, (4 pages).

* cited by examiner

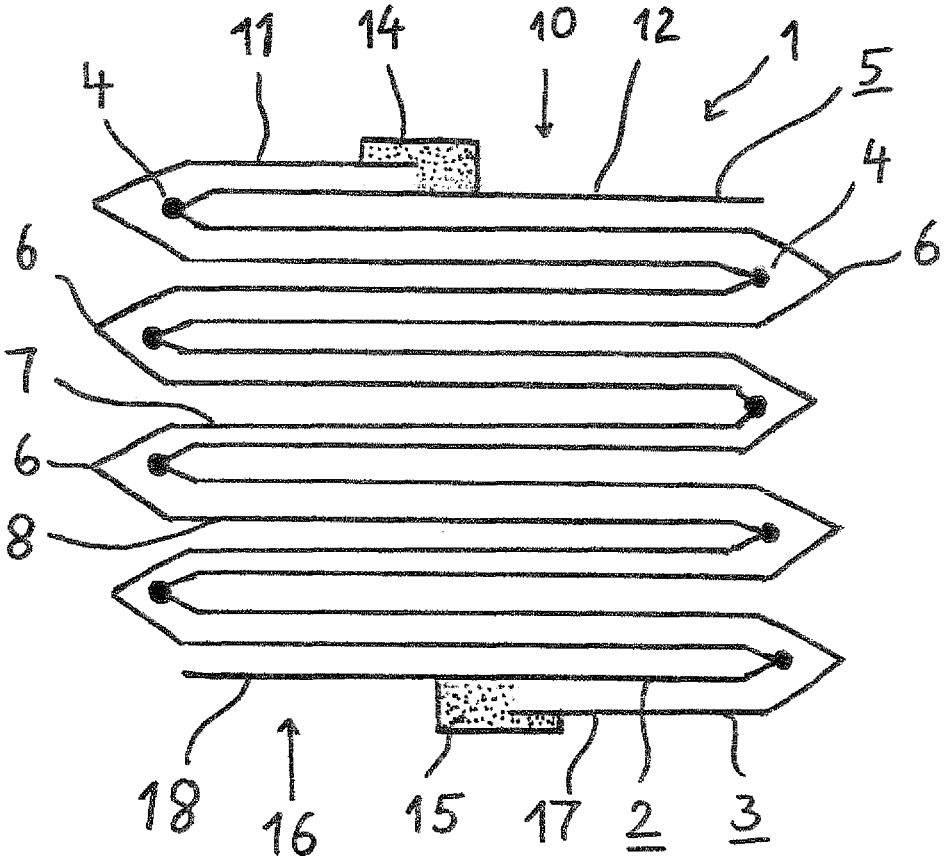
Fig. 1
Fig. 2
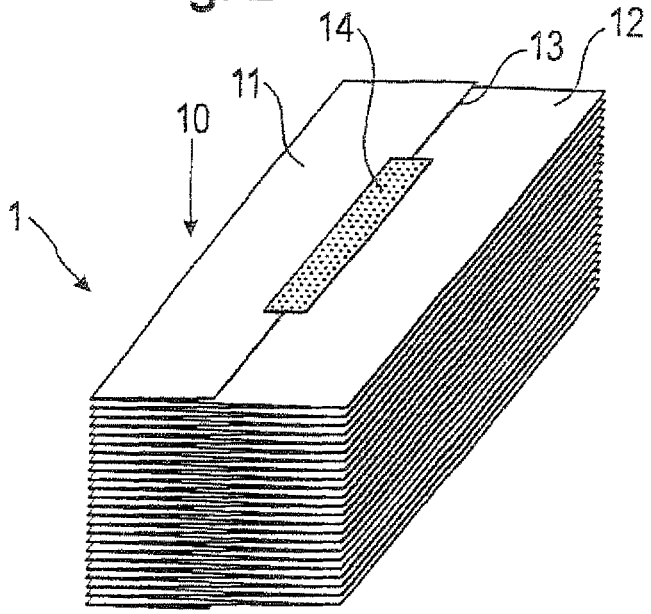

STACK OF FOLDED HYGIENE PRODUCTS AND METHOD AND APPARATUS FOR PRODUCING SAME

TECHNICAL FIELD

The present disclosure relates to a method for producing stacks of individual web sections, such as tissue web sections, from a continuous web of material. Further, the present disclosure relates to an apparatus for producing stacks of sheets, such as tissue sheets, from a continuous web of material as well as a stack of folded hygiene products, such as paper or woven products.

BACKGROUND

Towels, napkins and similar products for personal use and household use are used for many different purposes and industries for cleaning and machine wiping, in washing stations, in toilets, in offices and public premises. Different products can consist of a number of different qualities and constitute different hygiene- or wiping material, such as paper and tissue. Synthetic materials, natural materials and non-woven mixtures thereof may also be used. The products may have different uses and can among other things be used for hygiene, wiping, absorption, cleaning and polishing. Among some of the products that can be mentioned are paper towels, towels, different types of cloths, facial tissue, cosmetic tissue, napkins, kitchen towels, toilet paper and washing cloths. The products are made from a web of a hygiene- or wiping material and the web of material is in its length direction divided into sheets, i.e. separate products. Each separate product or sheet has a web length, which is folded in accordion-type style so that panels are formed between adjacent folds. The distance between two adjacent folds in longitudinal direction constitutes the panel width. The products which are folded in panels are often stored as more or less separate products placed as a sheaf and thus form a pile of panels. The web length for a single product traditionally corresponds to integer multiples of the panel width.

Such a pile of paper products is normally stored in a dispenser especially adapted for this purpose, for example a dispenser for consumer use. Such dispensers are often found in restrooms or restaurants, where the products are available for employees, the public, customers and clients. They may for example be placed on the wall, posts or the like. They are often free of charge for the user of the products and these types of product are often frequently and not especially sparingly used. Thus it is important to be able to optimize the storing capacity of dispensers in order to avoid the need of a frequent refilling of the dispensers.

A type of dispenser frequently encountered in the washrooms of airports, restaurants or other settings with a high frequency of customers is a dispenser from which the paper towels are withdrawn from stacks of interfolded paper towels. The paper is typically interfolded in a W-, Z- or V-configuration and it is intended that the user, when withdrawing one of the papers from the respective dispensing opening of the dispenser, grasps the leading end of the paper and pulls it out of the dispensing opening. The intention of the Z-, V- or W-shaped interfolding arrangement of the papers is that by withdrawing the leading paper, the next paper is automatically placed into its dispensing configuration. In particular, it is intended that its leading end is situated at the dispensing opening or even sticking out of the dispensing opening, such that it can be easily reached by the user.

However, this type of interfolded papers suffers the disadvantage that the leading end of the paper is not always in the right position for a user to be easily grasped. Accordingly, it happens from time to time that the user reaches through the dispensing opening and pinches the paper towels that are available there. In this situation, the user typically withdraws more than one single paper, and often pinches quite a number of papers which leads to a waste of paper and untidy the washrooms. This effect is particularly experienced when the stack of paper to be dispensed is squeezed into the dispenser such that the pressure on the lowest paper towel is relatively high. The same effect occurs if the stack of paper is relatively high so that the weight of the stack generates a relatively high pressure on the lowest paper towels.

This problem can be overcome when using an upwards dispensing type dispenser which is known from, for example, WO 2006/071148 A1. In an upwards dispensing type dispenser, it is the upper end of the stack which is lifted upwards into a dispensing mechanism. In such a way, the height of the stack and the corresponding pressure acting on the bottom part of the stack is no longer relevant.

When using upwards dispensing type dispensers with a very large supply of sheets, such dispensers have a relatively high height which can be up to 150 cm. This, in turn, places special requirements on the quality of the weakening lines between adjacent sheets because the material should not separate under the force of gravity at the weakening lines when it is lifted a long way upwards in a nearly empty dispenser. Usually used weakening lines are tab bonds with a remaining strength of less than 4%. Such tab bonds tend to separate under the force of gravity if the height of the dispenser is too high.

If the strength of the material at the weakening lines is selected to be relatively high, another problem arises. Usually, stacks of material are produced by separating the last sheet of the stack by striking the web with a separator arm. If the material at a weakening line is too strong, it is no longer possible to separate the web by striking the web with an arm.

SUMMARY

Thus, a solution is required for producing stacks of individual web sections, such as tissue web sections, which can be used in an upwards dispensing dispenser having a relatively high vertical height and, which at the same time, can be easily separated when producing stacks.

This object is solved by a method descried in the present disclosure, an apparatus descried in the present disclosure, and a stack of folded sheets descried in the present disclosure.

According to the present disclosure, the method for producing stacks of individual web sections, such as tissue web sections, from a continuous web of material comprises the steps of directing the continuous web to a perforating station; perforating the continuous web at predetermined intervals and forming sheets of web material between consecutive perforation lines extending laterally across the continuous web, the perforating being carried out by means of at least one perforation element arranged at the circumference of a perforation roller; directing the continuous web to a cutting station; cutting at second predetermined intervals the continuous web into web sections by means of a cutting element acting against an anvil element, in order to generate a clear cut or a tab-bond; folding the web sections by means of a folding roll; and stacking the folded web sections to generate a stack of folded sheets.

According to the present disclosure, there are two different method steps which weaken the web. On the one hand, there is a method step of perforating the continuous web in order to form perforation lines extending laterally across the continuous web. The term "perforation lines" as used herein should cover any intermittent or continuous weakening where the remaining strength of the web ranges between 4% and 50% and preferably between 4% and 15%. In other words, the weakening along a perforation line is relatively high. As a result of the perforation lines, the web can be transported upwards against gravity without the risk that the web separates at a perforation line. In the prior art, perforations have a higher percentage of remaining strength of the web. In this respect, it should also be noted that any schematic representation of dashed or dotted lines in the prior art cannot be used to derive the range of the fibers of the web which are cut along the perforation and the remaining strength resulting therefrom.

In addition to the perforation lines, the continuous web is cut into web sections by means of a cutting element which generates a clear cut or a tab-bond. A clear cut defines a complete cut of the web in which 100% of the fibers are cut. A tab-bond, however, defines a linear weakening at which the remaining strength of the web ranges between 0.5% and 4%, preferably between 0.5% and 3.5%, to form a tear-off weakening line which can be easily separated but, at the same time, still has sufficient strength to still process the sections of the web adjacent to the tab-bond as if it were a single web of material.

According to the inventive method, the continuous web is first provided with perforation lines at predetermined intervals before a different and subsequent processing step follows in which the continuous web is cut into web sections. Here, two alternatives are given. The web can either be separated by means of clear cuts, or tab-bonds can be used which, as outlined above, are characterized by a very high percentage of fibers cut resulting in a low residual strength. When folding and stacking the web sections, the web sections are separated in case that they are still connected together by means of a tab-bond.

The method according to the present disclosure provides an increased flexibility both with regard to the position and stability of the perforation lines and the position of the clear cuts or tab-bonds. The method gives full flexibility with regard to the position of the clear cuts or tab bonds resulting in dimensions of the top panels of a stack which is different to the dimensions of the stack as such.

According to the present disclosure, the apparatus for producing stacks of sheets, such as tissue sheets, from a continuous web of material, comprises a perforating station with a rotatable perforation roller with at least one perforation element arranged at the circumference of the perforation roller, wherein the perforation element is adapted to generate a perforation line. Further, the apparatus comprises a cutting station comprising a cutting element and an anvil element, wherein the cutting element is adapted to generate a clear cut or a tab-bond. Further, the apparatus comprises a folding station with a folding roll and a stacking station to form a stack of sheets. The above definitions of the terms "perforation line", "clear cut" and "tab-bond" apply throughout this patent specification. The perforation element can be a knife element which is protruding from the circumference of the perforation roller so that upon rotation of the perforation roller, the perforation element cuts some but less than half of the fibers either in a continuous weakening line or in an intermittent way.

The inventive stack of folded sheets of hygiene products such as paper or woven products comprises a web section of a predetermined length which is divided into a plurality of individual sheets of the hygiene product by means of perforation lines perpendicular to the length of the web section and between two consecutive sheets, respectively. The individual sheets are folded along at least one folding line positioned between adjacent perforation lines. One of the sheets forms a top panel of the stack at one end of the given length of the web section, the top panel having an end edge at a position different to those of the perforation lines and folding lines of the other sheets of the stack. In other words, the extension of the top panel in the direction of the length of the web section is shorter than that of the adjacent panel. A stack can comprise many individual sheets and, when being placed on a horizontal surface, can have a height of e.g. 20 cm. Thus, reference to a position different to those of the perforation lines and folding lines of the other sheets of the stack refers to the planes in which the other perforation lines and folding lines are situated. By having a top panel with an end edge at a position different to those of the perforation lines and folding lines of the other sheets of the stack, a high flexibility of the stacks, especially when combining different stacks together, can be achieved. Such combining together of individual stacks is especially important in upwards dispensing dispensers in which service personal usually refills the dispenser before the supply of sheets has been fully depleted. In this case, care has to be taken to combine a further stack in such a way to the preceding stack that the upwards dispensing function will not be interrupted and a failure-free operation of the dispenser continues.

According to a preferred embodiment, the method comprises after the folding of the web sections and before stacking the folded web sections the additional method step of adding adhesive properties to the web sections. Such additional method step serves to combine two stacks together in a high-capacity dispenser. To this end, the adhesive properties are added to the web section at a position at the top or bottom of the stack. In such a way, such stack can be easily adhesively connected to an adjacent stack.

When adding adhesive properties to the web sections, adhesive is preferably selectively ejected onto the folded web sections. This can be achieved by means of a control system which, depending on the length of the web sections only activates an injecting device at a position which, in the final stack, will form the top or bottom surface of the stack.

According to an alternative embodiment, an adhesive strip or a hook and/or loop fastener element is applied onto the folded web sections. This is an alternative method which serves to join to one another in a leading portion and/or trailing portion the stacks of hygiene products. The tape may be provided in the form of a double tape, or tape with one adhesive side and one side with another fastener, such as a mechanical fastener. Hook and/or loop fastener components are well-known in the art. In such a type of material minute hooks are densely packed on a substrate and shaped so that they can bond with a corresponding material by hook to hook interaction or hook to loop interaction.

Preferably, when directing the continuous web to a perforating station and when directing the continuous web to a cutting station, the continuous web is brought to a controlled speed. A controlled speed is important in order to make sure that the perforation lines are exactly positioned on the web.

When bringing the continuous web to a controlled speed, a first speed when directing the continuous web to a perforating station and a second speed when directing the continuous web to a cutting station are preferably different. Preferably, the second speed is higher than the first speed, and most preferably the second speed is up to 1% higher than the first speed. This measure serves for tensioning the web so that there is no slack in the web and the perforation lines will be placed accurately at a predetermined position.

According to a preferred embodiment, when perforating the web, the circumferential speed V1 of the perforation roller is adjusted to be different to the transport speed V2 of the continuous web at the position at which the continuous web is perforated. The circumferential speed V1 and the transport speed V2 are controlled to fixed values satisfying the equation $0.4 \times V2 \leq V1 \leq 1.4 \times V2$.

In other words, a further variability in the production method can be achieved by rotating the perforation roller at a circumferential speed which is different to that of the web transport speed, wherein the circumferential speed V1 can be varied to be up to −60% and up to +40% of the transport speed of the continuous web.

According to a preferred embodiment, the method steps of directing the continuous web to a perforating station, perforating the web, directing the web to a cutting station and cutting the web into web sections are carried out in parallel for two separate continuous webs, and in the step of folding the web sections, the web sections formed from the two separate continuous webs are interfolded to form a stack with interfolded sheets. In other words, the inventive method can be used both for stacks formed from one single web and stacks formed from two separate webs so that the web sections have interfolded sheets. A stack of interfolded sheets is advantageous because, when a user pulls the leading individual sheet of hygiene product, the second web is at the same time forwarded to the respective dispensing opening such that its leading end can be easily reached by the user. In other words, dispensing one sheet from one of the web sections automatically feeds the next sheet of the other web section into the dispensing position. A stack of interfolded dispenser napkins of this type is disclosed in WO 00/00072 A1.

According to a preferred embodiment of the inventive apparatus, the anvil element in the cutting station is a rotating anvil roller. Such anvil roller has the advantage that it can have a double function. Besides acting as an anvil element, it can cooperate with another roller to form a nip which holds the web sections and properly directs them to the subsequent folding roll of the folding station.

Preferably, the cutting element is a reciprocating knife operable by means of a cam mechanism to which the cutting knife is coupled. This is an easy mechanical solution which moves a cutting knife in a reciprocating manner and can be used as a highly precise tool e.g. for achieving tab-bonds with less than 1% of the fibers remaining uncut.

As an alternative preferred solution, the cutting element is an electrically operated reciprocating cutting knife. An electrical operation can be carried out at extremely short times so that a high speed movement is possible. The electrical operation can be realized e.g. by means of piezo elements having an extremely short response time and high precision.

According to a preferred embodiment of the inventive apparatus, the perforation roller has separate perforation knives distributed over the peripheral surface of the perforation roller, wherein at least one of the perforation knives is adapted to be selectively activated or to be put in an idle state. The selective operation of the individual knives can be used to generate a high flexibility in the production of the individual stack. Depending on the desired configuration of one sheet to be V-, W- or Z-folded, the number of perforation lines and folding lines should be varied. The possibility to adapt the perforation knives to be selectively activated or to be put in an idle state opens the possibility to use the apparatus for different formats of sheets and to change the configuration in an easy way from one to another configuration.

According to a preferred embodiment, the at least one perforation element is helically arranged on the circumferential surface of the perforation roller. This avoids undesired vibrations of the perforation roller because the perforation step of one perforation line takes place over a certain period of time and a lower cutting pressure is required because, during operation, the active point at which the perforation element cuts the web continuously travels along the length of the helically arranged perforation element.

Preferably, the apparatus further comprises a web tensioning device arranged upstream and downstream of the perforating station. Preferably, such web tensioning device is designed to frictionally hold and transport the web at a controlled speed. Most preferably, the tensioning device is a nip between two rollers or an S-wrap around two rollers. When using an S-wrap around two rollers, the rollers are preferably coated with a surface material which enhances the friction between the roller and a web of tissue material. In this respect, tungsten-coated rollers show very good results with regard to the ability to frictionally hold the web.

According to a preferred embodiment, the cutting element is adapted to generate a tab-bond and the stacking station comprises a separating element to separate web material at the tab-bonds. The separating element can e.g. be designed as separator fingers which apply a force on the tab-bonds so that the remaining weak bond between adjacent web sections brakes and individual stacks can be formed. The reason why tab-bonds are preferable is the easier handling of the web as long as the individual web sections are still coherent to one another and form a quasi-continuous web.

According to a preferred embodiment, the folding roll is operatively coupled to a source of sub-atmospheric pressure. Such vacuum folding roll is a technically easy and reliable means for accurately folding the web sections into a predetermined configuration.

Preferably, the stacking station further comprises a counting device, preferably a counting finger, adapted to determine the length of a web section. Such counting fingers can be used to determine a position at which a stack of a predetermined size ends and, in case of the provision of tab-bonds between adjacent web sections, to selectively operate separating elements which apply mechanical force to the tab-bonds to finally fully separate the adjacent web sections to form separate stacks.

According to a preferred embodiment of the stack of folded sheets of hygiene products, the end edge of the top panel is at an angle relative to the perforation lines. The perforation lines run perpendicularly to the length of the web which means that the end edge runs in a direction different to 90% relative to the length of the web section. This geometry is especially advantageous in case of stacks with interfolded sheets.

According to a preferred embodiment, the stack further comprises a second web section, preferably of the same predetermined length as the (first) web section, and being divided into a plurality of second sheets of the hygiene product by means of second perforation lines. The second sheets are also folded along at least one second folding line positioned between adjacent perforation lines. The web sections and second web sections are interfolded such as to form a nested configuration, wherein the perforation lines and second perforation lines are offset with respect to one another along the web sections. Further, the second web section forms a second web panel. The offset arrangement of the perforation lines and second perforation lines means that the second web section also includes perforation lines which do not coincide with the position of the perforation lines of the first web. As an example, the perforation lines of the second web can be offset with respect to the perforation lines of the web section by one distance between the respective folding positions of the individual sheets. In other words, at the position of the perforation lines of the (first) web section, the second web section does not show perforation lines, and at the positions of the perforation lines of the second web section, the (first) web section does not show perforation lines. Accordingly, when a user withdraws an individual hygiene product from the interfolded web sections, the individual hygiene product will either tear at the respective perforation lines of the web section or second web section but not at perforation lines at both web sections at the same time.

According to a preferred embodiment, the stack further comprises an adherence layer for adhering a start of the stack to an end of a preceding stack, the adherence layer being positioned on the sheet and the second sheet such that the top panel and second top panel at the start of the stack are adhereable to the end of an identical preceding stack adjacent to the stack. Such configuration is possible because, as outlined above, the cutting of the webs independently of the provision of perforation lines makes it possible to dimension the top panel and second top panel in any desired way so that the top panel and the second top panel can both be exposed to the top or bottom of the stack.

Preferably, the adherence layer is a layer of glue, a layer of adhesive tape or a mechanical fastener such as the layer of a hook or a loop component of hook and loop fastening material or a layer of hook component of hook and hook fastening material or other known adherence means. Preferably, the adherence layer is provided in the shape of a strip of adherence material, such as a tape.

According to a preferred embodiment, the top panel of the web section and the second top panel of the second web section are shaped and arranged so that they are exposed to the top side and/or bottom side of the stack, wherein the adherence layer is applied on both the top panel and the second top panel. In this way, one single adherence layer can be used to couple two adjacent stacks, both of which are formed from interfolded sheets of material.

BRIEF DESCRIPTION OF THE DRAWINGS

In the following, examples will be described by means of a specific preferred embodiment of the present disclosure. In the drawings, FIG. 1 shows a cross-sectional view of a stack of hygiene sheet products comprising first and second webs that are interfolded with each other;

FIG. 2 schematically shows a stack of hygiene sheet products, either consisting of one web section or two web sections with an adherence layer provided on the top side of the stack;

DETAILED DESCRIPTION

Figure 3A:
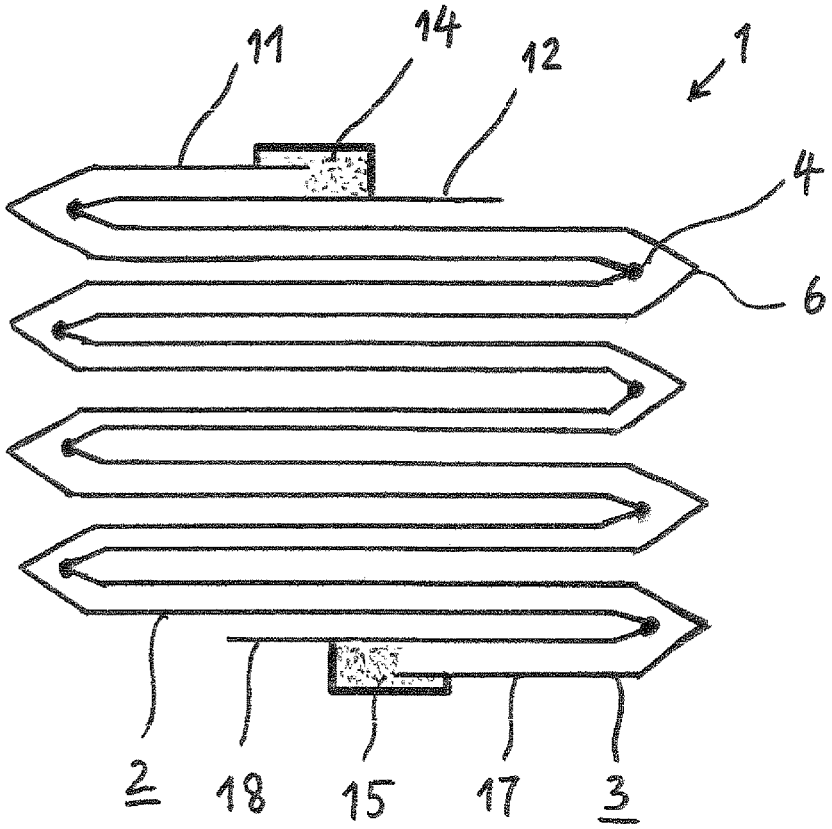
FIGS. 3*a* and 3*b* schematically show another stack of hygiene sheet products consisting of two interfolded web sections.

In the following description, the same or similar elements will be denoted by the same reference numerals throughout the individual drawings.

FIG. 1 shows a stack 1 of interfolded webs, namely the (first) web section 2 and the second web section 3. the first and second web sections 2, 3 are divided into separable hygiene sheet products (e.g. paper hygiene product, paper towel products, tissue products, or the like) by perforation lines 4 extending laterally across the elongate webs 2, 3. The perforation lines 4 are illustrated in FIG. 1 with filled-in circles for clarity. Although the term "perforation line" is used, the above-given definition applies that this term is supposed to define intermittent or continuous weakenings, where the remaining strength of the web ranges between 4% and 50% and preferably between 4% and 15%.

The perforation lines 4 for the first web section 2 are positioned offset from the perforation lines 4 for the second web sections 3 along the longitudinal direction of the web sections 2, 3 so that, if the first web section 2 is pulled through a dispensing opening, the second web section 3 will be pulled through the dispensing opening with it. The first web section 2 will thus brake at the first perforation line 4 in the dispensing order to leave a pull tab portion of the second web portion 3 protruding beyond the end of the first web section 2 for convenience of grasping at the dispensing opening. This process will alternate during dispensing of the stack 1 so that a separable sheet product of the second web section 3 is presented more forwardly than a product of the first web section 2 relative to the dispensing opening, which will then be the product that is dispensed by a user and then a product of the first web section will be more forwardly presented at the dispensing opening for the dispensing by a user, as a result of the offset perforation lines of the first web section 2 and the second web section 3. Such a stack ensures one at a time dispensing of hygiene sheet products, while also ensuring that the first and second web sections 2, 3 move together along a dispensing path as a result of face-to-face interaction of the webs 2, 3.

The perforation lines 4 of the first web section 2 and the second web section 3 define separable sheets of the stack 1. The interfolding pattern for the stack 1 shown in FIG. 1 is such that each separable sheet 5 is folded at a fold line 6 to form first and second panels 7, 8 for each sheet 5. The interfolding pattern is also such that fold line 6 of one of the web sections 2, 3 is provided at each perforation line 4 of the other of the web sections 2, 3. In this way, the interfolding pattern provides a fold line 6 for the first web section 2 at a perforation line 4 for the second web section 3 and correspondingly a perforation line 4 for the first web section 2 at a fold line 6 of the second web section 3.

The example given in FIG. 1 is just one manner of interfolding first and second web sections 2, 3 providing separable sheets 5 in an offset manner relative to a dispensing opening containing the stack 1. Other implementations can be provided. For example, the perforation lines 4 may be positioned offset from the fold lines 6 of the other web, rather than being aligned with a fold line 6 as shown in FIG. 1. Further, the first and second web sections 2, 3 may be folded such that each sheet 5 can be of any length. Each sheet includes more than two panels 7, 8 as shown, such as three, four, five or more panels. The variable length leads to panels having a size different to that of adjacent panels which could e.g. sum up to a total length of 4.2 panels.

Further, shown in FIGS. 1 and 2, is a top surface 10 of the stack 1 which is a planar surface that can be seen when the stack 1 is viewed from above looking down at the top of the stack 1. The top surface 10 is defined partly by a top panel 11 of the first web section 2 and partly by a top panel 12 of the second web section 3. The top panel 11 of the first web section 2 overlays the top panel 12 of the second web section 3 but is cut away along an end edge 13 (FIG. 2) so as to reveal the underlaying top panel 12 of the second web section 3. As can be seen in FIGS. 1 and 2, the size of the top panel 11 is smaller than that of the adjacent panel of the same sheet. This makes it possible to use an adherence layer 14 which, in the present embodiment, is partly applied on the top panel 11 of the first web section 2 and partly on the top panel 12 of the second web section 3. The adherence layer can be embodied by doubled sided adhesive tape. One side of the adhesive tape 14 is adhered to the top panels 11, 12. The double sided adhesive tape 14 may include a release liner to shield the underlaying sticky tape during processing and which is to be removed when the stack is positioned against an adjacent stack in the dispenser so that the two stacks a secured together.

In the embodiments as shown in FIGS. 1 and 2, the adherence layer 14 is elongate and extends parallel to the fold lines 6. The adherence layer could also be applied perpendicular to the configuration shown and still be able to serve the purpose of being applied on both the first and the second web sections 2, 3 so as to stick both first and second web sections 2, 3 to the last hygiene products or product of a preceding stack in a dispenser. Other adherence layers may be used than double sided adhesive tape with a release liner. For example a strip of glue may be rolled or sprayed on the first and second web sections 2, 3. Another example would be the use of one component of a hook and/of loop fastener which may require the other component of the hook and/or loop fastener to be provided at the bottom of the preceding stack in a dispenser. Alternatively, a hook component could be provided that it is adhereable directly to the material, e.g. on paper based material, at the bottom of a preceding stack by nature of the fineness of the hooks. In this alternative a mating loop component would not be necessary. However, in many cases a mating component is included as shown with reference numeral 15 in FIG. 1.

Figure 3B:
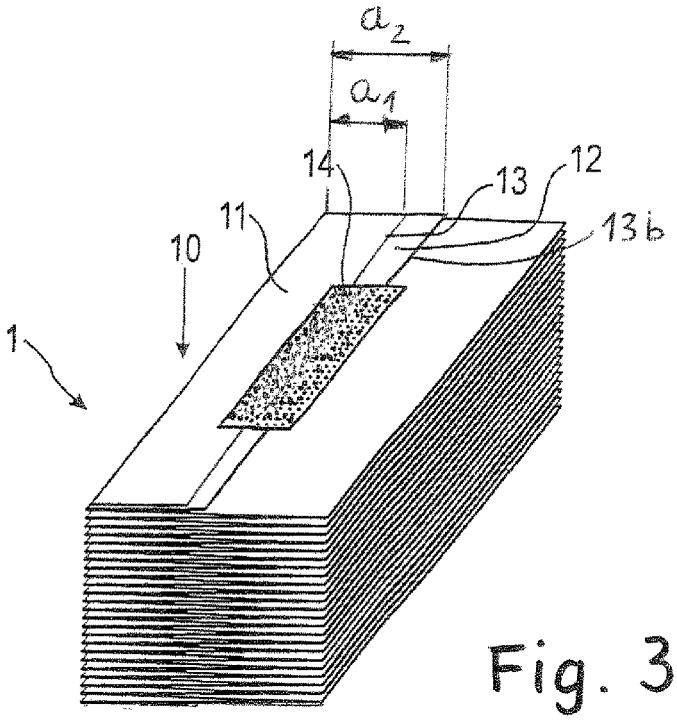

FIGS. 3*a* and 3*b* additionally show the top panel 12 of the second web section 3 which has a size different to the top panel 11 of the first web section 2. Accordingly, there is a second end edge 13*b* at a distance $a_2$ to the side edge of the stack 1 which is different to the distance $a_1$ of the end edge 13 of the first web section 2. The distances $a_1$, $a_2$ are only represented by way of example. The inventive method and device gives total freedom with regard to the dimensions of the individual top panels.

Referring now to the corresponding adherence layer 15 as shown in FIG. 1, which is provided at a bottom surface 16 of the stack, it can be seen that the bottom surface 16 of the stack 1 is defined partly by a bottom panel 17 of the second web section 3 and a bottom panel 18 of the first web section 2. The bottom panel 17 of the second web section 3 overlays the bottom panel 18 of the first web section 2 and has been cut away in a complementary way to that as described above for the top panels 11, 12 of the first and second web sections 2, 3. This complementary end edge at opposing ends of the stack 1 is a convenient result of the manufacturing process in that cutting way a top panel of the stack 1 so as to reveal an underlaying panel will provide a complementary cut in the next stack in the manufacturing process, thereby resulting in each stack produced having complementary end edges at the top and bottom surfaces thereof.

It should be noted that the configuration as shown in FIG. 2 is also applicable to a product with only one single web section. Due to the complementary position of the end edges on the top surface and bottom surface of the stack 1, the same position of the adherence layer 14 on top and on bottom of the stack ensures an appropriate fixing together of subsequent stacks. Further, the geometry can be selected such that service personnel does not have to differentiate what is the top surface and what is the bottom surface of the stack. Top surface and bottom surface can be provided symmetrically.

Figure 4:
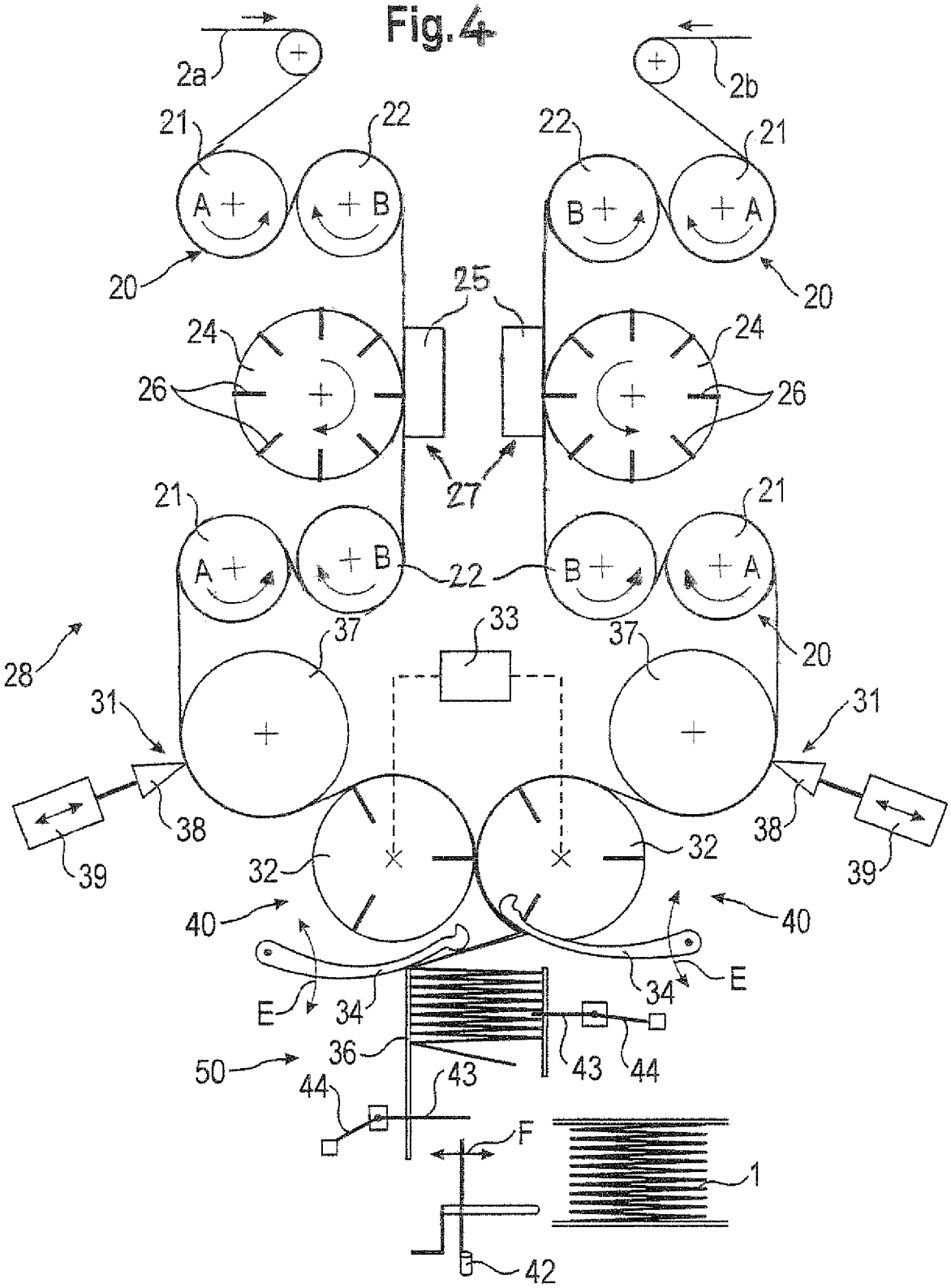
FIGS. 4 and 5 schematically show the method and apparatus for producing interfolded sheets of hygiene products.

FIG. 4 schematically shows the method and apparatus for producing a stack of interfolded sheets as shown in FIG. 1.

A first continuous web 2*a* and a second continuous web 2*b* are continuously conveyed to a first tensioning device 20, respectively. The first tensioning device consists of two rollers which are rotated in opposite directions A and B and around which the first web 2*a* and second web 2*b* are wound in an S-shaped manner. There is a gap between the two rollers 21, 22 so that the webs 2*a*, 2*b* are not pinched in a nip between the two tensioning rollers. Due to the S-shaped contact of the webs around the rollers 21, 22, a high contact area between the web and the rollers is generated leading to a high friction between the webs and the rollers. In order to increase the friction, conventional methods can be applied like varying the surface roughness of the circumferential surface of rollers 21, 22. A convenient way of increasing the friction is to cover the circumferential surfaces of the rollers with tungsten. Due to the friction between the webs 2*a*, 2*b* and the first tensioning device 20, the transport speed of the webs 2*a*, 2*b* is brought exactly to the circumferential speed of rollers 21, 22.

After leaving the first tensioning device 20, the webs 2*a*, 2*b* are directed to perforation stations 27 with perforation rollers 24 which act against anvil elements 25, respectively. The perforation rollers 24 are rotated at a circumferential speed which can be different to the transport speed of the webs 2*a*, 2*b*. The circumferential speed of the perforation rollers can be adjusted within a range of −60% and +40% relative to the conveying speed of the webs 2*a*, 2*b*.

The perforation rollers are provided with several perforation knives 26 which, according to a preferred embodiment, can be selectively activated or put in an idle state. This serves to use the device as schematically shown in FIG. 3 for various types of sheets consisting of two, three, four or even a higher number of panels for each sheet.

The perforation rollers generate perforation lines which run perpendicular to the length direction of the webs 2*a*, 2*b*. In order to avoid vibration of the perforation rollers, the time period of the perforation action can be extended by providing helical perforating elements to generate a continuously moving position at which a perforating element penetrates into the webs 2*a*, 2*b*.

Subsequent to the perforation rollers 24, there is a second tensioning device 20 which uses the same principle as explained above for the first tensioning device.

Preferably, the conveying speed of webs 2*a*, 2*b* at the second tensioning device is slightly higher than the conveying speed of the webs at the first tensioning device. The difference in speed can be up to 1%. This serves to tighten the web at the position at which the webs run through the perforating stations 27.

After leaving the second tensioning device, the webs 2*a*, 2*b* are directed to a cutting station 31 comprising anvil rollers 37 and cutting knives 38 which are functionally coupled to a suitable mechanism 39 which moves the cutting knife 38 in a reciprocating manner. When operated, the cutting knife 38 provides either a clean cut or a tab-bond so as to divide the webs 2*a*, 2*b* into individual web sections 2, 3. The web sections are then transported to the vacuum folding device generally denoted by reference numeral 40. The mechanism 39 can be a cam mechanism or an electrically operated mechanism like a piezoelectric actuator.

When leaving the cutting station 31, the web sections 2, 3 are directed to a vacuum station 40 with vacuum folding rollers 32 which are connected to a device 33 generating sub-atmospheric pressure at parts of the circumference of the vacuum folding rollers 32. This serves to make the webs alternately adhere to one of the two vacuum folding rollers which operatively cooperate with packer fingers 34 which are moved in the direction of arrows E and are used to separate the two web sections 2, 3 from the vacuum folding rolls 32 and to direct the folded web sections 2, 3 into the stacking station 50.

The stacking device 36 can be of any conventional type known to a skilled person. It is provided with a loader finger 42 adapted for a reciprocating movement in the direction of arrow F, separator fingers 43 moving upwards and downwards in the vertical stacking arrangement as shown in FIG. 3 and count fingers 44 which work together to count a predetermined number of folded sheets before the separator fingers cut off the web sections in case of still existing tab-bonds and before a finished stack is moved downwards and conveyed by loader finger 42 in the direction perpendicular to the stacking direction and away from the device.

Figure 5:
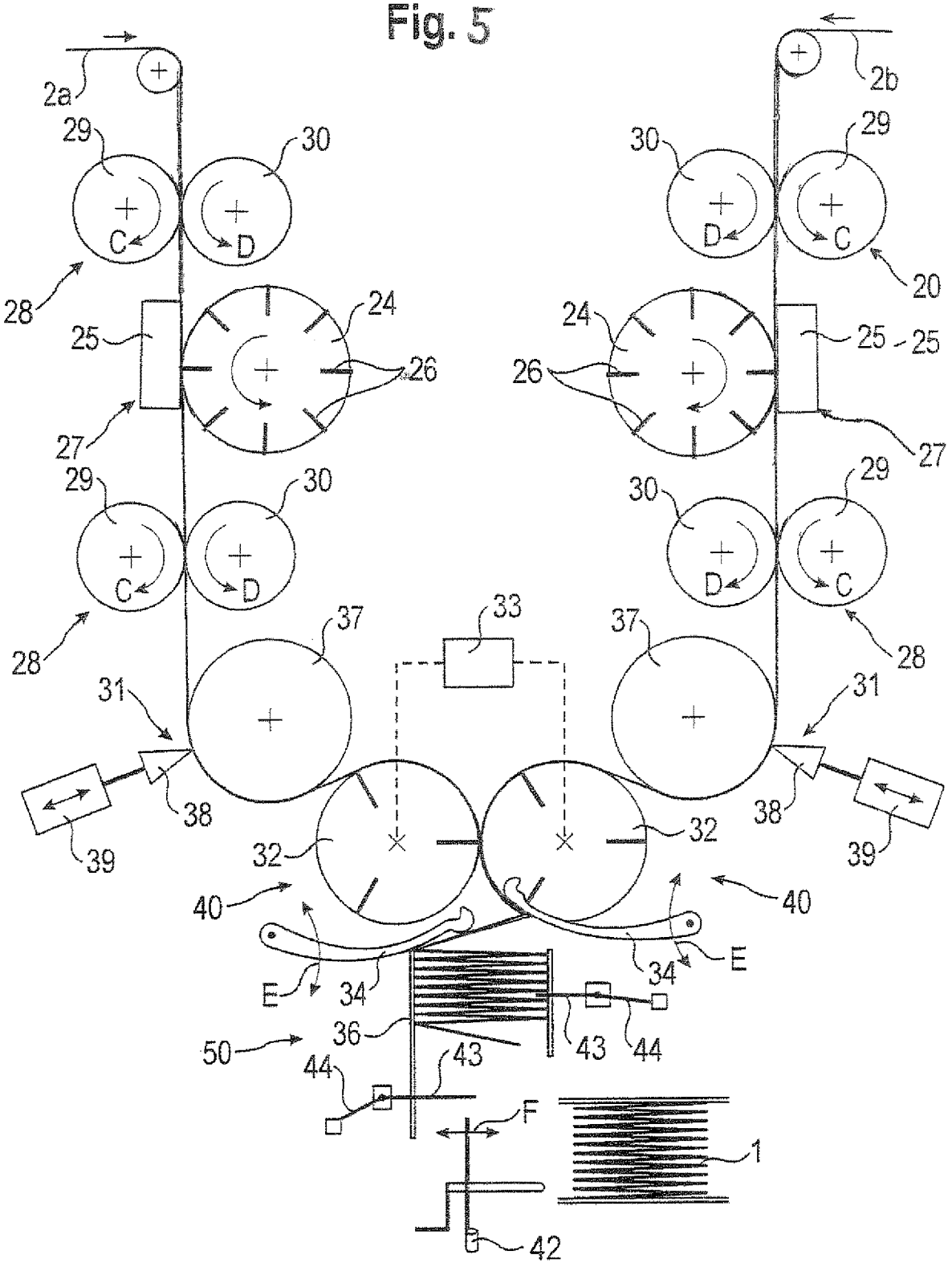

FIG. 5 is very similar to FIG. 4 and serves to schematically show a different type of tensioning device. In FIG. 5, tensioning devices 28 upstream and downstream the perforating device 27 are used which are embodied as the nip between two rollers 29, 30 rotating in opposite directions C, D. The first and second tensioning devices 20, 28 as shown in FIGS. 4 and 5 are only examples of possibilities to provide a tensioning of webs 2*a*, 2*b* and any variation of S-wraps around rollers and nips between rollers can be freely varied.

Although in the schematical representation in FIG. 3 a horizontal stacking machine has been shown, the key aspect of the embodiment can also be realized when using a horizontal stacking machine. It is the key aspect of the embodiment that besides the perforating device 27, a separate cutting device 31 is provided so that the position of the end edges of the top panels within one stack can be freely selected according to the specific needs of the user. The perforation lines can be made mechanically strong enough so that they can withstand the gravity force in an upwards dispensing dispenser with a considerable height of its supply magazine. Further, free selection can be made whether clear cuts or tap-bonds are realized in the cutting station since this operation is fully independent of the perforation step. When interfolding two web sections as shown in FIG. 3, the webs 2*a*, 2*b* are processed independently up to the folding rollers. Nevertheless, a central control unit is provided so that the perforation lines and clear cuts or tab-bonds can be adequately provided and positioned offset to each other in order to realize a stack as explained above with reference to FIG. 1.

The invention claimed is:

1. A method for producing stacks of individual web sections from a continuous web of material, comprising the steps of:

(a) directing the continuous web to a perforating station;

(b) perforating the continuous web at predetermined intervals and forming sheets of web material between consecutive perforation lines extending laterally across the continuous web, the perforating being carried out via at least one perforation element arranged at the circumference of a perforation roller;

(c) directing the continuous web to a cutting station;

(d) cutting at second predetermined intervals the continuous web into web sections via a cutting element acting against an anvil element, to generate a clear cut or a tab-bond;

(e) folding the web sections via a folding roll; and (f) stacking the folded web sections to generate a stack of folded sheets; wherein in step (b) the continuous web is frictionally held and transported at a controlled speed via a web tensioning device arranged upstream and downstream of the perforating station, wherein the web tensioning device comprises two rollers upstream of the perforating station, with a gap between the rollers and the continuous web such that the continuous web is not pinched between the rollers.

2. The method according to claim 1, comprising, after step (e) and before step (f):

(e2) adding adhesive properties to the folded web sections.

3. The method according to claim 2, wherein in step (e2) adhesive is selectively ejected onto the folded web sections.

4. The method according to claim 2, wherein in step (e2) an adhesive strip or a hook and loop fastener element is applied onto the folded web sections.

5. The method according to claim 1, wherein in steps (a) and (c), the continuous web is brought to a controlled speed.

6. The method according to claim 5, wherein a first speed in step (a) and a second speed in step (c) are different.

7. The method according to claim 6, wherein the second speed is higher than the first speed.

8. The method according to claim 1, wherein in step (b) a circumferential speed V1 of the perforation roller is adjusted to be different to a transport speed V2 of the continuous web at a position at which the continuous web is perforated, the circumferential speed Viand the transport speed V2 being controlled to fixed values satisfying the equation: $0.4\times V2 \leq V1 \leq 1.4\times V2$.

9. The method according to claim 1, wherein steps (a) to (d) are carried out in parallel for two separate continuous webs; and in step (e) the web sections formed from the two separate continuous webs are interfolded to form a stack of interfolded sheets.

10. The method according to claim 1, wherein the continuous web of material is a hygiene or wiping material.

11. The method according to claim 1, wherein the continuous web of material is selected from the group of paper towels, facial tissue, cosmetic tissue, napkins, kitchen towels, and toilet paper.

12. The method according to claim 1, wherein the web tensioning device further comprises two rollers downstream of the perforating station, with a gap between the rollers and the continuous web such that the continuous web is not pinched between the rollers.

13. The method according to claim 1, wherein the web tensioning device is designed to frictionally hold and transport the web at a controlled speed, the web tensioning device being an S-wrap around two rollers.

14. An apparatus for producing stacks of sheets from a continuous web of material, comprising:

a perforating station with a rotatable perforation roller comprising at least one perforation element arranged at the circumference of the perforation roller, wherein the at least one perforation element is adapted to generate a perforation line;

a cutting station comprising a cutting element and an anvil element, wherein the cutting element is adapted to generate a clear cut or a tab-bond;

a folding station with a folding roll;

a stacking station to form a stack of sheets; and a web tensioning device arranged upstream and downstream of the perforating station, wherein the web tensioning device comprises two rollers upstream of the perforating station, with a gap between the rollers and the continuous web such that the continuous web is not pinched between the rollers.

15. The apparatus according to claim 14, wherein the anvil element is a rotating anvil roller.

16. The apparatus according to claim 14, wherein the cutting element is a reciprocating cutting knife operable via a cam mechanism to which the cutting knife is coupled.

17. The apparatus according to claim 14, wherein the cutting element is an electrically operated reciprocating cutting knife.

18. The apparatus according to claim 14, the perforation roller having several perforation knives distributed over the peripheral surface of the perforation roller, wherein at least one of the perforation knives is adapted to be selectively activated or to be put in an idle state.

19. The apparatus according to claim 14, wherein the at least one perforation element is helically arranged on the circumferential surface of the perforation roller.

20. The apparatus according to claim 14, wherein the web tensioning device is designed to frictionally hold and transport the web at a controlled speed, the web tensioning device being an S-wrap around two rollers.

21. The apparatus according to claim 14, wherein the cutting element is adapted to generate a tab-bond; and the stacking station comprises a separating element to separate the web material at the tab bond.

22. The apparatus according to claim 21, wherein the separating element is a separating finger.

23. The apparatus according to claim 21, the stacking station further comprising a counting device adapted to determine a length of a web section.

24. The apparatus according to claim 14, wherein the folding roll is operatively coupled to a source of sub-atmospheric pressure.

25. The apparatus according to claim 14, wherein the continuous web of material is a hygiene or wiping material.

26. The apparatus according to claim 14, wherein the continuous web of material is selected from the group of paper towels, facial tissue, cosmetic tissue, napkins, kitchen towels, and toilet paper.

27. The apparatus according to claim 14, wherein the web tensioning device further comprises two rollers downstream of the perforating station, with a gap between the rollers and the continuous web such that the continuous web is not pinched between the rollers.

* * * * *